US008256771B2

(12) United States Patent
Marquez

(10) Patent No.: US 8,256,771 B2
(45) Date of Patent: Sep. 4, 2012

(54) ROULETTE PAYOUT CALCULATOR

(76) Inventor: Alicia Marquez, Las Vegas, NV (US)

( * ) Notice: Subject to any disclaimer, the term of this patent is extended or adjusted under 35 U.S.C. 154(b) by 555 days.

(21) Appl. No.: 12/511,113

(22) Filed: Jul. 29, 2009

(65) Prior Publication Data

US 2011/0028197 A1 Feb. 3, 2011

(51) Int. Cl.
*A63B 71/00* (2006.01)

(52) U.S. Cl. ..... 273/148 R; 273/138.1; 273/139; 273/141 R; 273/142 R; 273/142 E; 463/17

(58) Field of Classification Search ..... 463/17; 273/138.1, 139, 141 R, 142 R, 142 E, 148 R
See application file for complete search history.

(56) References Cited

U.S. PATENT DOCUMENTS

| | | | | |
|---|---|---|---|---|
| 2,866,601 | A * | 12/1958 | Naber | 235/114 |
| 3,627,200 | A * | 12/1971 | Sadler | 235/88 G |
| 3,803,389 | A * | 4/1974 | Yelverton | 235/78 N |
| 2,810,627 | A | 5/1974 | Levy | |
| 3,819,186 | A | 6/1974 | Hinterstocker | |
| 4,357,659 | A * | 11/1982 | Nathans | 700/93 |
| 4,402,509 | A * | 9/1983 | Dersher | 273/148 R |
| 4,744,098 | A | 5/1988 | Grabowski | |
| 5,042,810 | A | 8/1991 | Williams | |
| 5,106,091 | A | 4/1992 | Comito | |
| 5,588,650 | A | 12/1996 | Eman et al. | |
| 5,769,417 | A * | 6/1998 | Richer et al. | 273/148 R |
| 6,260,846 | B1 * | 7/2001 | Rudd | 273/148 R |
| 6,283,856 | B1 * | 9/2001 | Mothwurf | 463/17 |
| D460,497 | S * | 7/2002 | Johnstone et al. | D21/369 |
| 6,572,474 | B2 | 6/2003 | Rudd | |
| 6,769,693 | B2 | 8/2004 | Huard et al. | |
| 7,337,946 | B2 * | 3/2008 | Belton | 235/89 R |
| 2003/0114212 | A1 | 6/2003 | Mothwurf | |
| 2004/0077425 | A1 | 4/2004 | Goossens et al. | |
| 2004/0251624 | A1 * | 12/2004 | Hodapp et al. | 273/139 |
| 2006/0258427 | A1 | 11/2006 | Rowe et al. | |
| 2009/0061981 | A1 | 3/2009 | Smith | |

FOREIGN PATENT DOCUMENTS

| | | | |
|---|---|---|---|
| JP | 06-165849 | A | 6/1994 |
| JP | 06-254208 | A | 9/1994 |
| JP | 2005-334303 | A | 12/2005 |
| WO | WO 98/17360 | A1 | 4/1998 |
| WO | WO 02/08923 | A2 | 1/2002 |
| WO | WO 2008/101204 | A1 | 8/2008 |

* cited by examiner

*Primary Examiner* — David L Lewis
*Assistant Examiner* — Chase Leichliter
(74) *Attorney, Agent, or Firm* — Kevin J. Snyder; John V. Stewart

(57) ABSTRACT

A mechanical calculator that computes payouts for combinations of roulette bets. A number wheel (50) has an array of payout numbers (54) for a combinations of two types of bets over a range of chips, such as up to 20 chips on a street bet and up to 20 chips on a line bet. A mask wheel (40) overlays the number wheel (50). Windows (44) on the mask wheel each reveal an individual number (54) on the number wheel, depending on the relative rotational positions of the mask and number wheels, which are manually selectable with knobs (28, 32). A cover plate (22) overlays the mask wheel, and has a window (26) that reveals a single combined payout number (54) on the number wheel under a mask window (1-20) and the cover plate window (26). Rotational index numbers (49, 68) indicate the number of chips selected for each bet.

17 Claims, 12 Drawing Sheets

ROULETTE PAYOUT CALCULATOR

FIELD OF THE INVENTION

This invention relates to mechanical payout calculators for combinations of roulette wagers.

BACKGROUND OF THE INVENTION

Roulette is a gambling game in which a croupier spins a wheel in one direction then rolls a ball in the opposite direction on a tilted rim surrounding the wheel. The ball eventually falls into one of many colored and numbered pockets on the wheel. Players place bets on various aspects of the result, such as the winning number, the color of the pocket, whether the number is odd or even, etc. The pockets are numbered from 1 to 36, alternating between red and black. There is a green pocket numbered 0. In American roulette, there is a second green pocket marked 00. Pockets are not in numerical order around the wheel. Some consecutive numbers are the same color.

Players can make a variety of "inside" bets by selecting the number of the pocket the ball will land in or a range of pockets based on their position, and/or players can make "outside" bets on various positional groupings of pockets, pocket colors, or odd or even pocket numbers. The payout odds for each type of bet are based on its probability of success. The table usually imposes minimum and maximum bets, and these limits usually apply separately for all of a given player's inside and outside bets for each spin. Players can continue to place bets until the dealer announces "No more bets." Betting areas on a roulette table are covered with cloth having a tabular arrangement known as a layout.

Inside Bets

Straight: a bet on a single pocket number.

Split: a bet on two adjoining numbers on the layout.

Street: a bet on three numbers on a single horizontal line on the layout.

Corner: a bet on four numbers in a square arrangement on the layout.

Line: a bet on two adjoining streets on the layout.

In a typical roulette game, odds are paid out by the casinos on inside bets as follows:

- a straight bet pays 35 to 1. A single chip wining on a straight pays 35 chips.
- a line bet pays 5 to 1;
- a street bet pays 11 to 1;
- a corner bet pays 8 to 1;
- a split bet pays 17 to 1;

Players can make different types of bets on the same game. After the wining number is determined, the croupier must then determine the payout to each winning player. The mathematical calculations of multiplying and adding to determine combined payouts can be cumbersome and error-prone.

SUMMARY OF THE INVENTION

The invention is a mechanical calculator that computes payout sums for combinations of bets in roulette. There is a long-felt need for a reliable device that helps croupiers perform these calculations to avoid miscalculating the payout. It is an object of the present invention to provide a calculating device that assists croupiers in quickly determining payouts to roulette players.

BRIEF DESCRIPTION OF THE DRAWINGS

The invention has parts with numbers printed thereon. Any number without an underline or a lead line is a number printed on a part of the invention. Any number with an underline or lead line is a reference numeral. Some elements are referenced both generically and specifically.

FIG. 1 is a top view of the invention set for wagers of 10 street and 10 line chips.

FIG. 3 is top view of a mask wheel for street bets.

DETAILED DESCRIPTION

The invention is described herein in embodiments designed to compute bets for up to twenty chips placed on each of two types of bets in roulette. For this reason, the number twenty appears frequently throughout the description. However, this number is not a limitation. More or less chips can be accommodated, depending on calculator physical size considerations. More chips require more numbers on the number wheel. The exemplary limit of twenty shown herein is sufficient to calculate most bets, and is enough to illustrate the features of the invention. The invention is illustrated using various types of inside bets in roulette as examples. However, it can also support other types of bets in roulette or other wagering games.

Figure 1:
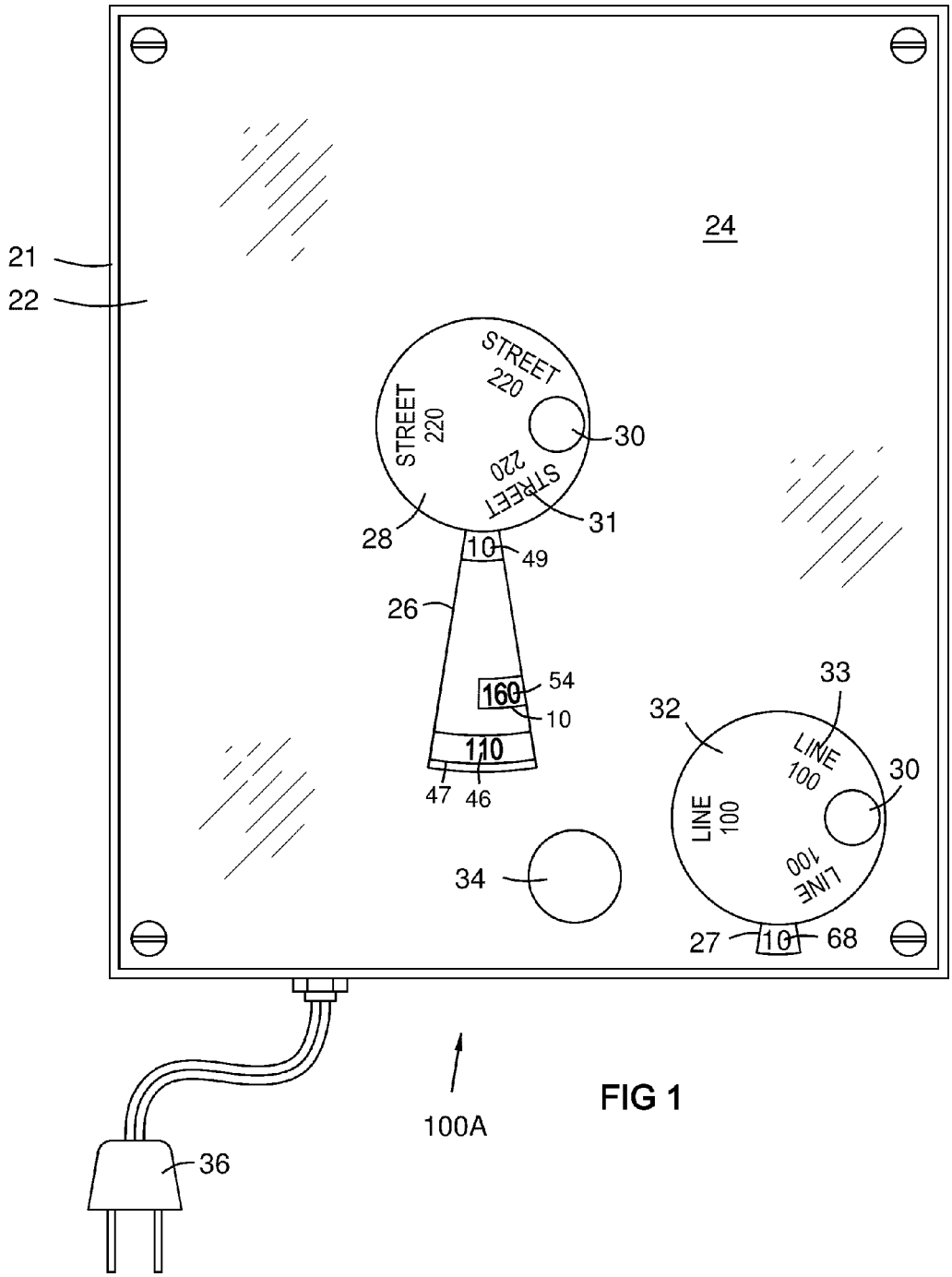
In FIG. 1 the mask windows 44 are referenced generically.

FIG. 1 is a top view of a calculator 100A according to the invention, configured for street and line bets. It has a base 21 and a cover plate 22. The base may be formed as a box as shown. The cover plate has an opaque portion 24, first and second transparent windows 26, 27, holes for first and second rotatable knobs 28, 32, and optionally a hole for a lamp button 34. The knobs 28, 32 may be thumb wheels with a fingertip depression 30, and may have labeling that indicates a type of bet selected via the knob. A power cord 36 may be provided for an internal lamp as later described. FIG. 1 shows the knobs 28, 32 positioned for 10 chips on a street bet and 10 chips on a line bet, as indicated by respective index numbers 49 and 68. Identifying labeling 31, 33 may be provided to indicate the types of bets supported by a particular calculator 100A.

Figure 2:
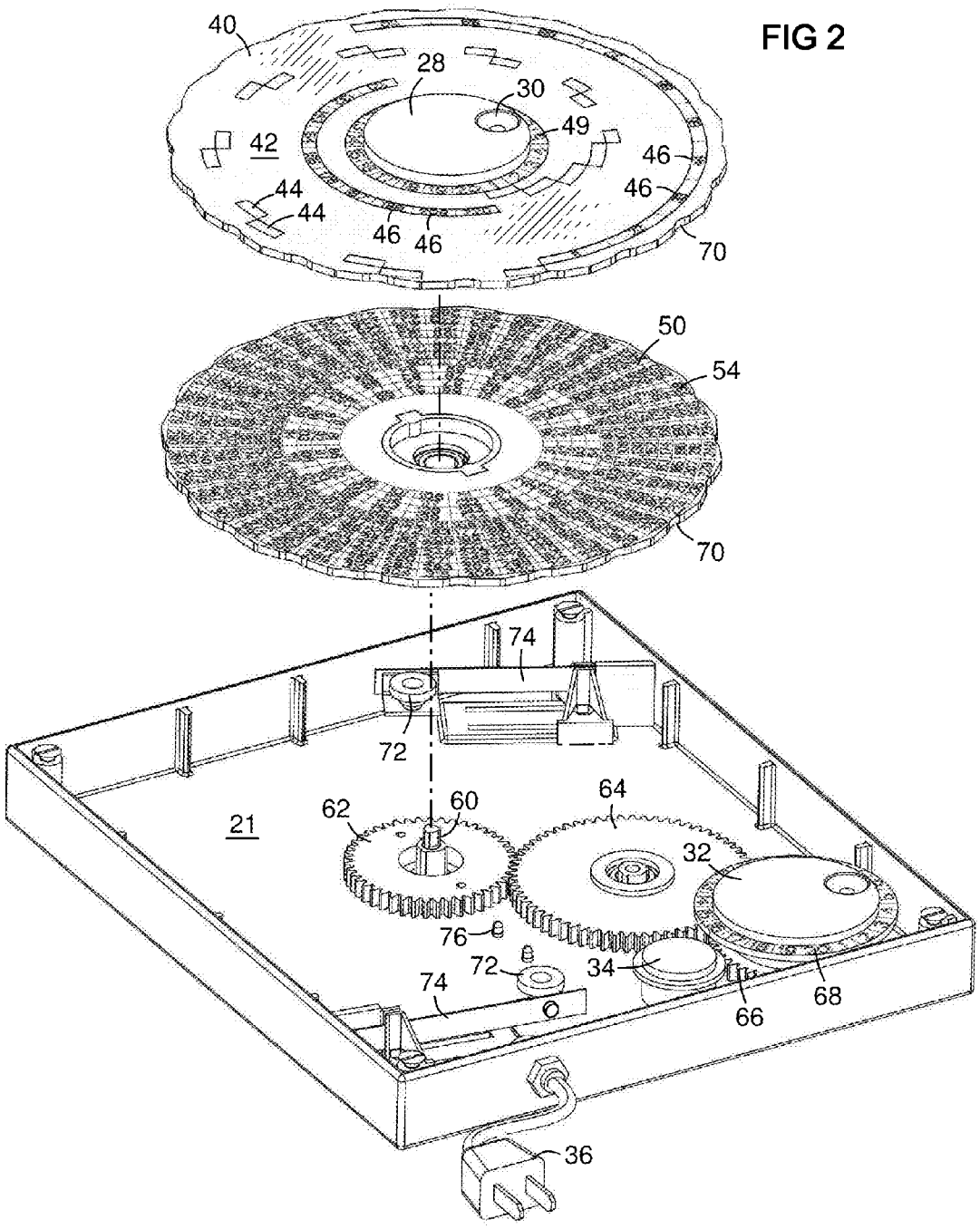
FIG. 2 is a partly exploded view of FIG. 1 with the cover removed. Indicia shown on parts in this view are not expected to be legible. They are shown clearly in other views.

FIG. 2 is a partly exploded view of FIG. 1 with the cover plate 22 removed. The first knob 28 is fixed to a mask wheel 40 with an opaque portion 42, twenty mask windows 44, twenty numeric labels 46, and a ring of index numbers 49. The mask wheel is rotatably mounted on a first axle 60. A number wheel 50 is rotatably mounted below the mask wheel on the first axle 60. A first gear 62 is rotatably fixed to the number wheel. A second intermediate gear 64 drives the first gear 62.

A third gear 66 drives the second gear 64. The third gear 66 is rotatably fixed to, and driven by, the second knob 32. A circular array of index numbers 68 is attached to the second knob 32. One number of this array is displayed through window 27 of the cover plate 22, indicating an amount of the second type of bet, and indicating a corresponding selected position of the number wheel 50.

The mask wheel 40 and the number wheel 50 may each have a circumference with twenty detents 70 for one or more spring-loaded detent rollers 72 that releasably halt the wheels 40, 50 in rotational alignments with each other and with the cover plate window 26 at user-selected positions. Herein "detent" means a restraint that checks the motion of something. Each detent roller 72 may be mounted on a leaf spring 74 fixed to the base 21. As the roller drops into a depression 70 in the circumference of the mask and/or number wheel, it checks the motion of the wheel.

One or more lamps 76 such as light-emitting diodes may be provided under the number wheel and positioned below the cover plate window 26 for backlighting, controlled by the switch 34. For backlighting, the number wheel may be translucent or transparent with opaque numbers 54. Without backlighting, the number wheel may have an opaque background color that contrasts with the numbers 54, such as black numbers on a white background or vice versa.

Figure 3:
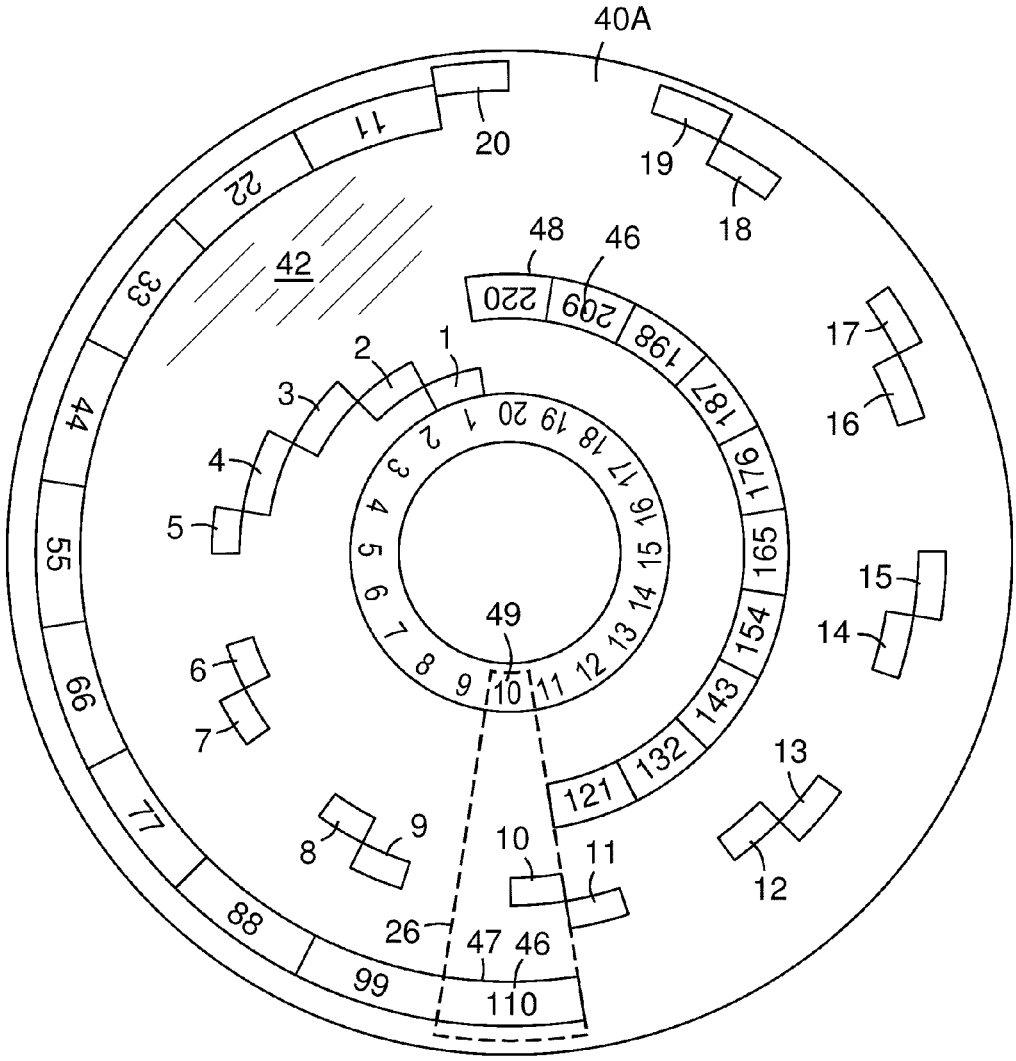
In FIG. 3 these windows are referenced individually with reference numerals 1-20. In the description, a number that is printed on a part is shown in quotes ("NN") to distinguish it from a reference number (NN).

FIG. 3 shows a top view of a mask wheel 40A for street bets. It is mostly opaque 42 except for twenty clear windows 1-20 that are each positioned to show a given combined payout number 54 of the number wheel 50 through the window 26 of the cover plate 22. The position of the cover plate window 26 is shown as a dashed line. The particular combined payout number shown through a window 1-20 depends on the relative rotational positions of the mask wheel 40A and the number wheel 50. The rotational position of the mask wheel is indicated by a ring of twenty index numbers 49 in sequence from "1" to "20". One of these index numbers shows through the radially inner end of window 26 of the cover plate 22.

The mask wheel 40A has twenty numeric labels 46, each of which shows a given multiple of the first type of bet, here street bets, through the window 26 of the cover plate depending on the rotational position of the mask wheel 40. The mask wheel in FIG. 3 is in the same position as in FIG. 1. Index number "10" is selected to compute a bet of ten chips on a street. The numeric label 46 with printed number "110" is radially aligned with the index number "10", so it shows through the cover plate window 26. This indicates that the payout for a bet of ten chips on a street is 110 chips. The numeric labels 46 may be arranged in at least two arcs—for example an outer arc 47 and an inner arc 48. These multiple arcs are positioned to avoid interfering with the mask windows 1-20. The purpose of this arrangement is to avoid enlarging the diameter of the mask wheel 40A to accommodate a full ring of numeric labels around the circumference of the mask wheel radially beyond the distal mask window 20.

Mask window 10 is shown radially aligned with the index number "10". Mask window 10 will show a number on the number wheel 50, and shows the payout for a combination of ten chips on a street plus a selected number of chips on another type of bet, depending on the bet type of number wheel 50 and its rotational position. Mask window 4 is much larger than mask window 5. This is due to a transition on the number wheel as later described between a single radial column of numbers and a double radial column of numbers. Mask windows 1-4 are configured for a single radial column, while mask windows 5-20 are configured for a double column. This configuration is not a requirement of the invention, but it reduces the diameter of the mask and number wheels.

Figure 4:
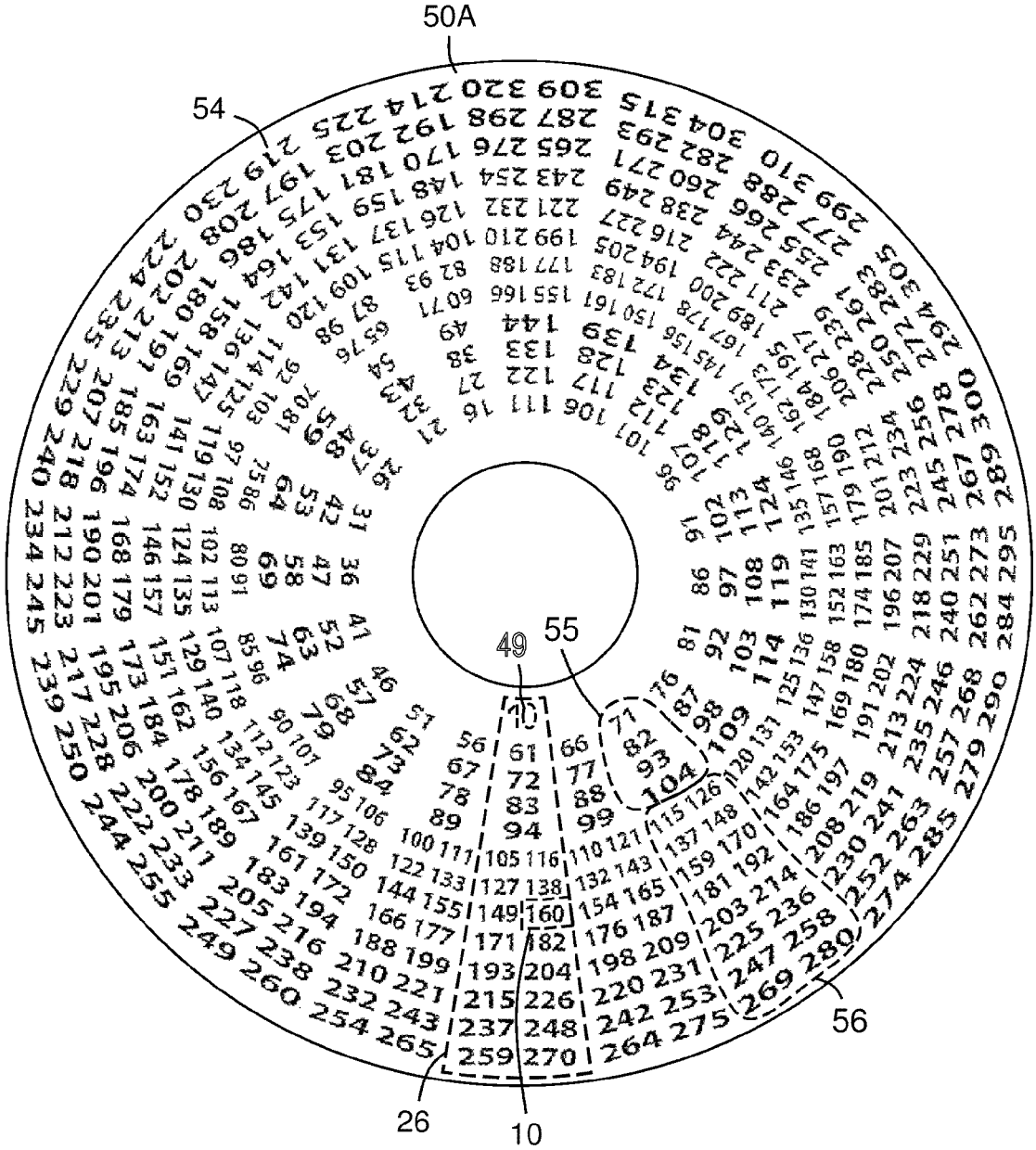
FIG. 4 is top view of a number wheel for combined street and line bets.

FIG. 4 shows a number wheel 50A with payout numbers for a combination of a line bet and a street bet, allowing up to twenty chips on each bet. The positions of cover plate window 26 and mask window 10 are shown in dashed lines. Index number 49 on the mask wheel 40A is also shown in dashed line. The only payout number from the number wheel that shows through the mask wheel is "160" as seen through mask window 10. This is the payout amount for the combination of 10 street bets plus 10 line bets. Street bets pay 11 chips per chip bet, and line bets pay 5 chips per chip bet, so a win on 10 street chips and 10 line chips pays (10*11)+(10*5)=160.

The payout numbers on the number wheel 50A are arranged in radial wedges and concentric circles. One radial wedge is outlined by the cover plate window 26 shown in dashed lines. The radially innermost number of a wedge, such as "61" indicates a single bet of a first type, combined with a bet of a second type multiplied by the index number 46. In this example, "61" indicates the payout for one line chip (1*11=11) plus ten street chips (10*5=50) for a total of 11+50=61. The wedges as shown have an inner portion 55 with a single radial column of payout numbers, and an outer portion 56 with a double radial column. The use of a double column reduces the number of concentric circles in this example from 20 to 12, thus reducing the diameter of the number wheel. If there were only a single radial column of numbers in each radial wedge there would be twenty concentric circles of numbers. The transition from single to double radial columns may be done at a different point than shown in this example.

In view of the single/double column arrangement it is possible to understand the geometry of the mask windows 1-20 on the mask wheel 40A. Mask windows 1-4 extend across the width of the cover plate window 26 to show the payout numbers in the single column portion 55. Mask windows 5-20 only extend across half the width of the cover plate window 26 (or a little more than half, given the space between the double columns) to show only one of the two numbers at a given radius in the double column portion 56.

Figure 5:
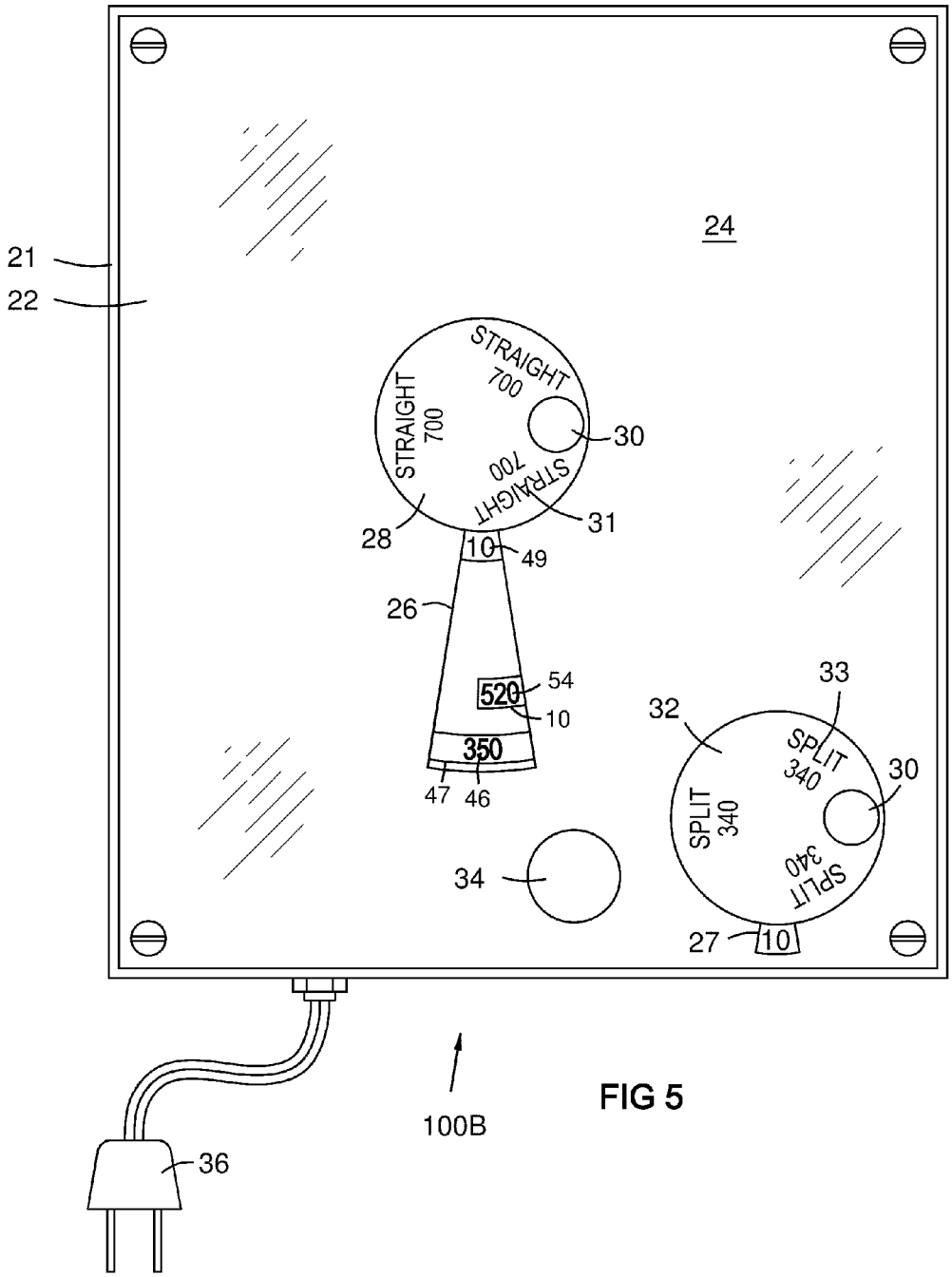
FIG. 5 is a top view of the invention set for bets of 10 straight and 10 split.
Figure 6:
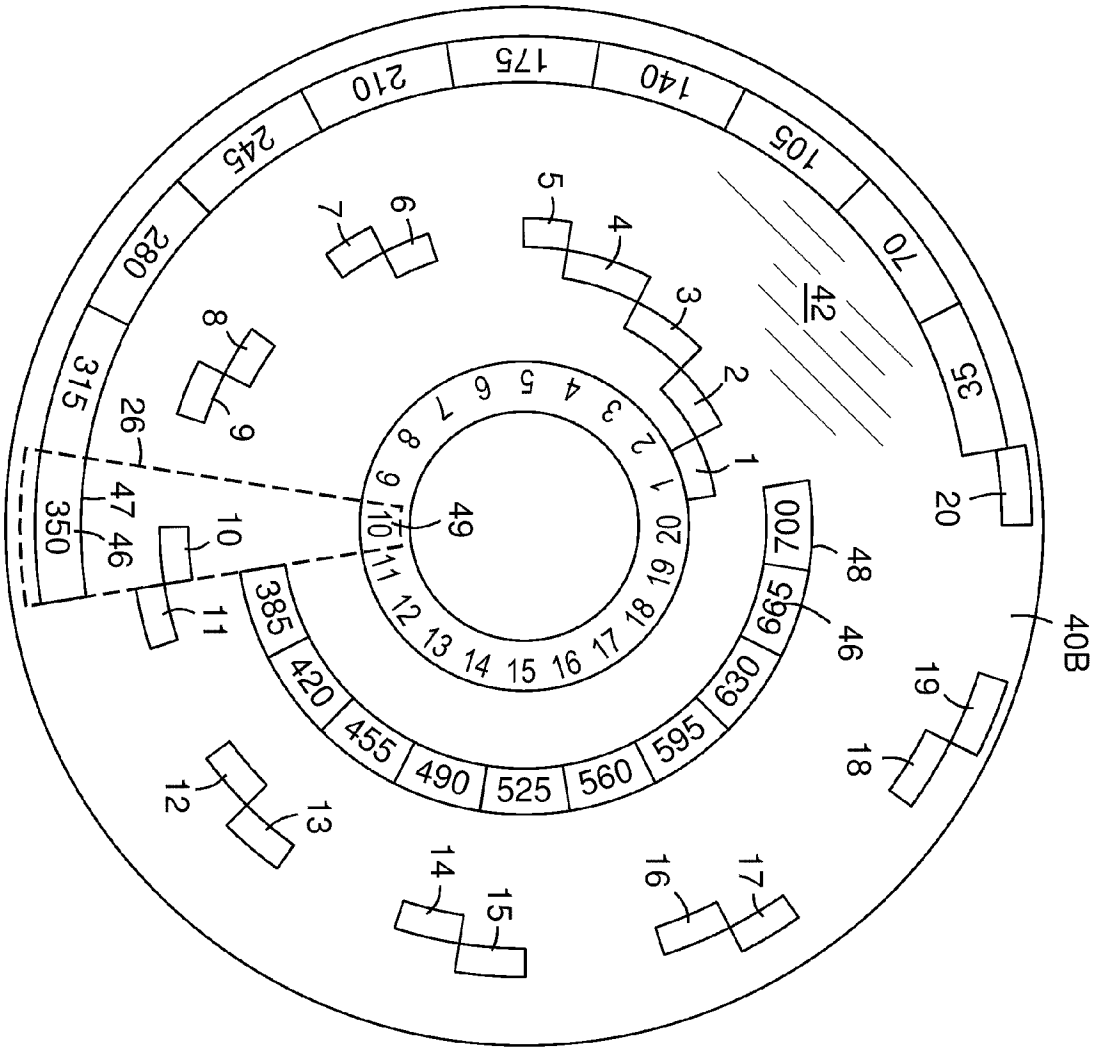
FIG. 6 is top view of a mask wheel for straight bets.
Figure 7:
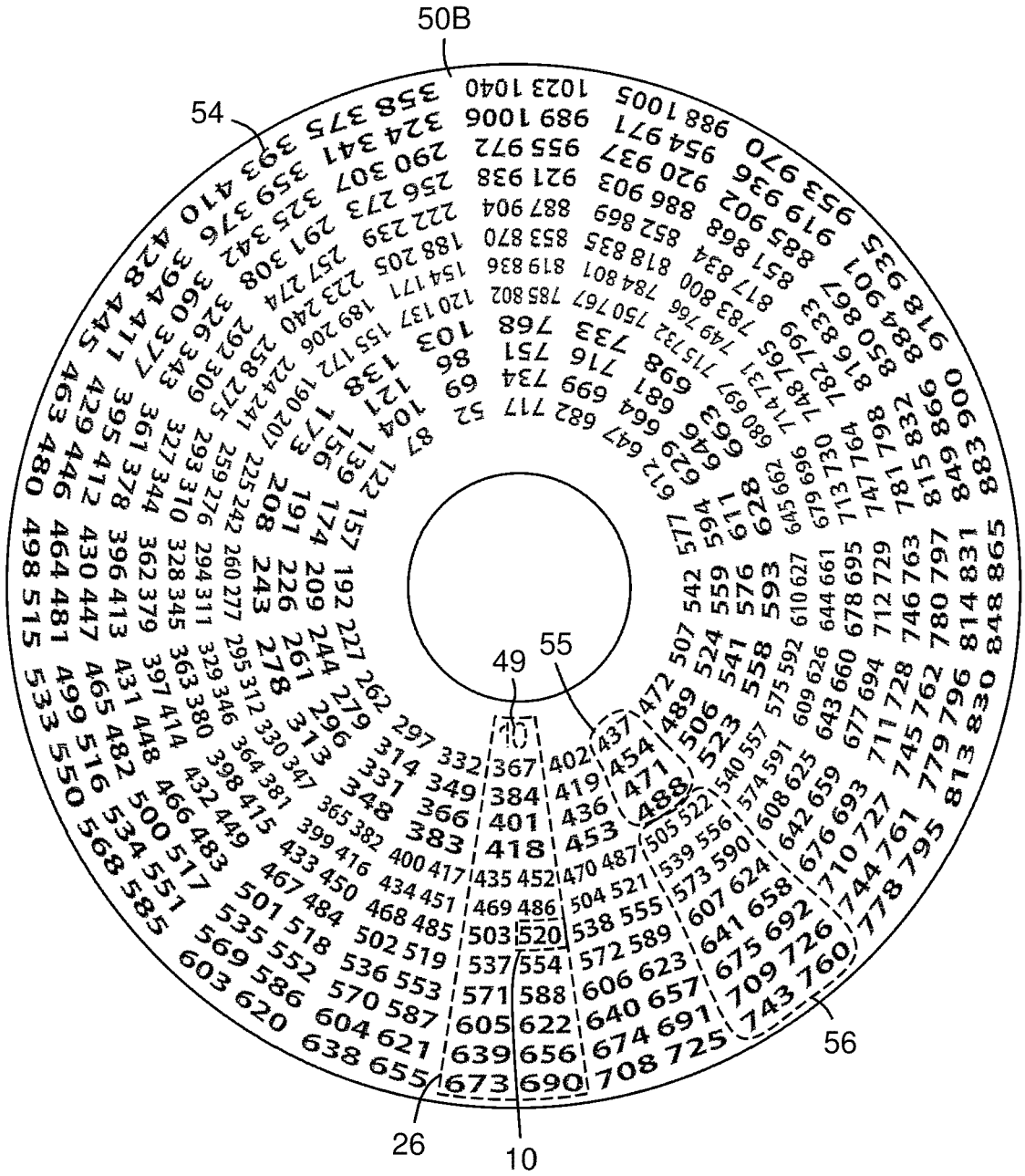
FIG. 7 is top view of a number wheel for combined straight and split bets.

FIG. 5 is a top view of an embodiment of the calculator 100B configured for straight and split bets. It is shown with the knobs 28, 32 positioned for 10 chips on each type of bet. FIG. 6 shows a mask wheel 40B for straight bets, as used in the embodiment of FIG. 5. FIG. 7 shows a number wheel 50B for straight and split bets as used in the configuration of FIG. 5. The mask and number wheels are interchangeable with other mask and number wheels for different types of bets.

Figure 8:
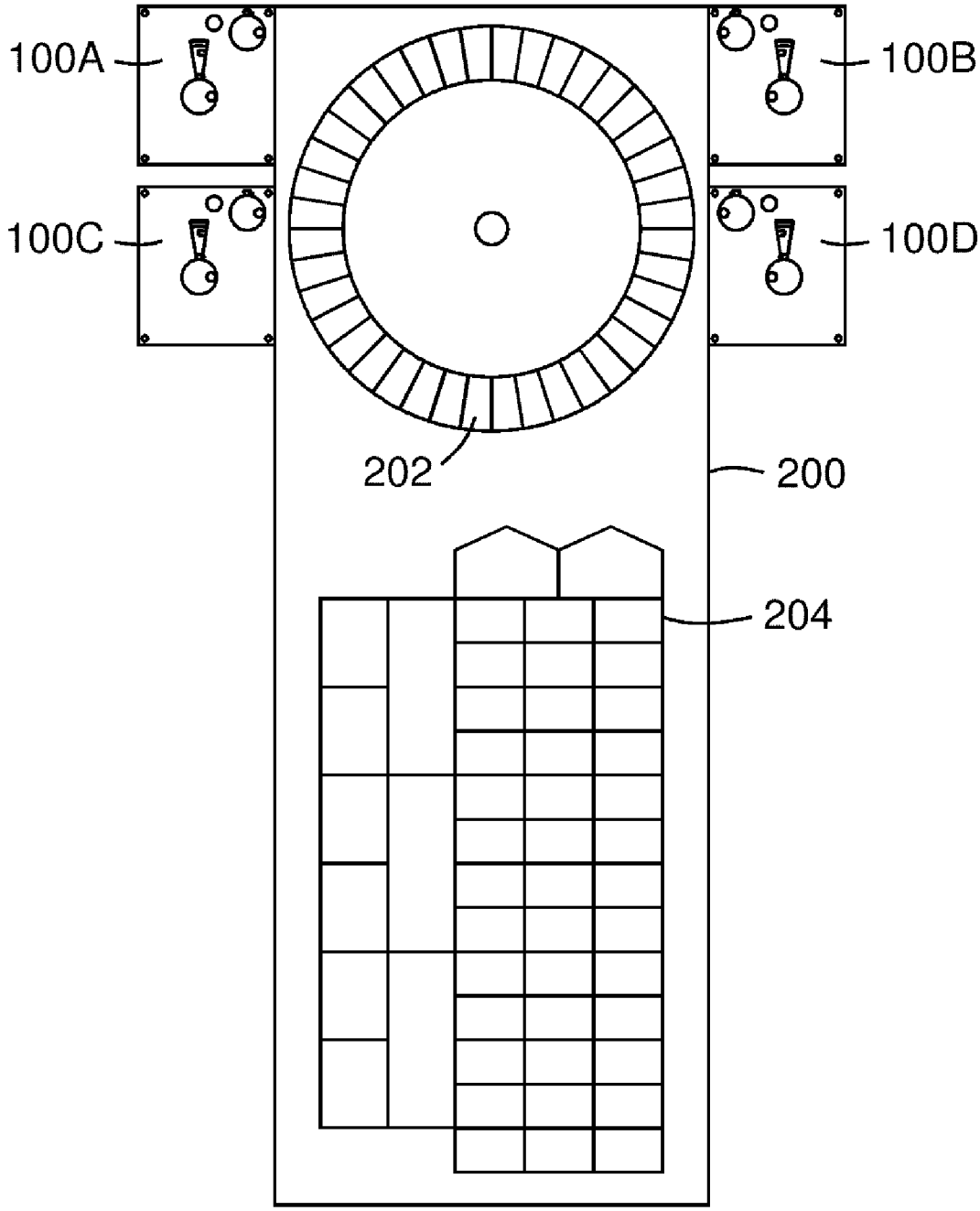
FIG. 8 shows a roulette table with four calculators for different combinations.
Figure 9:
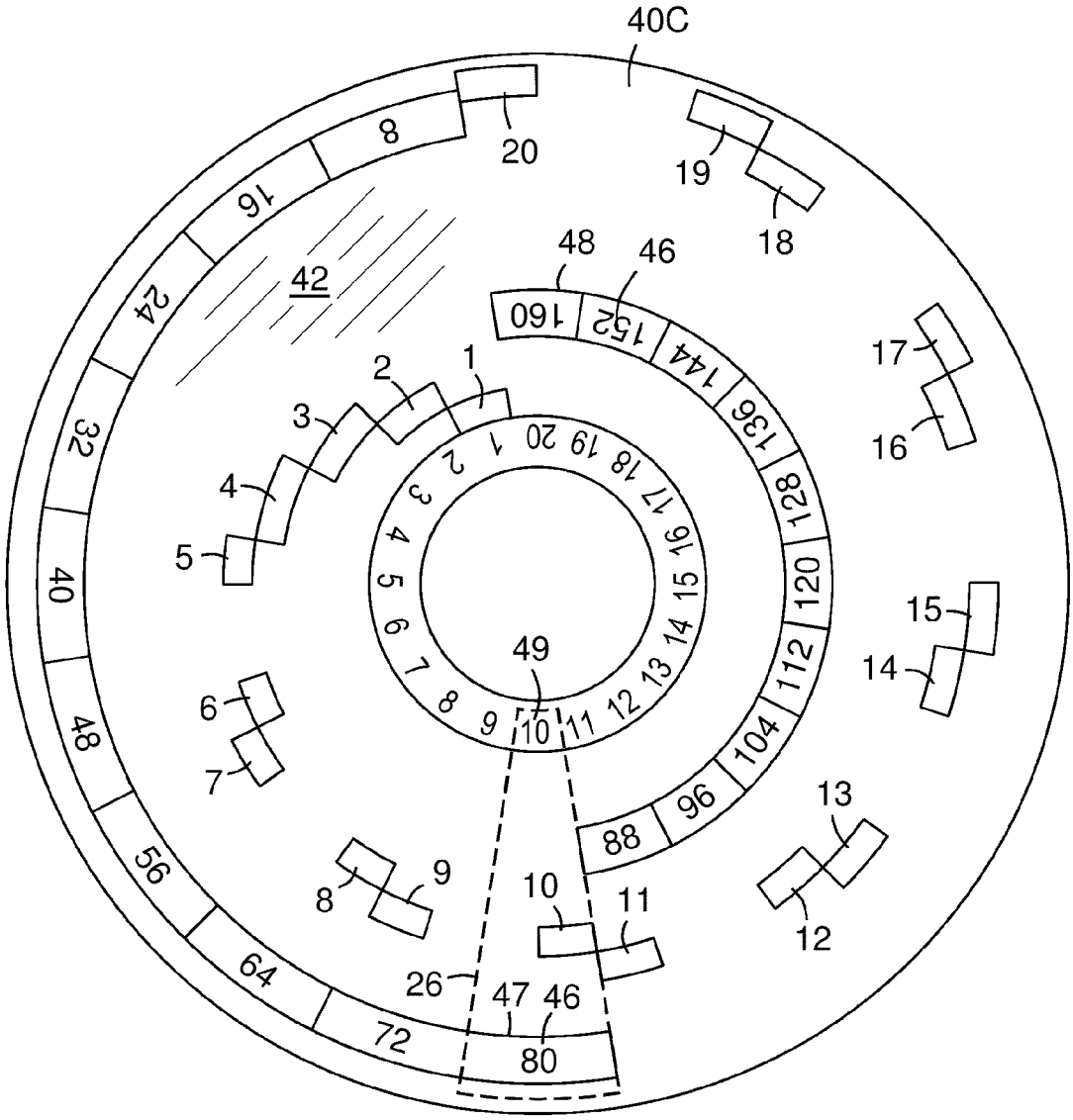
FIG. 9 is top view of a mask wheel for corner bets.
Figure 10:
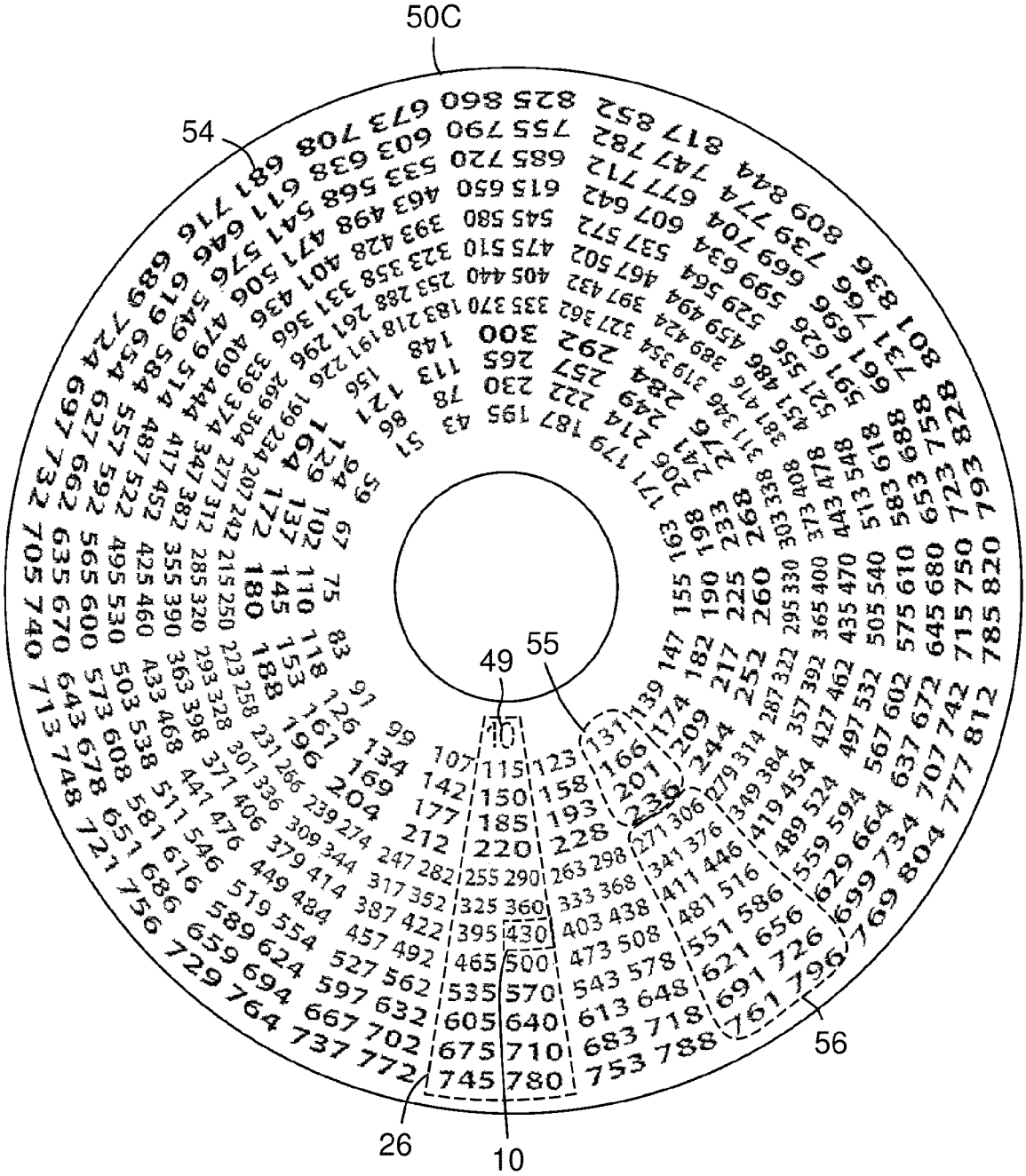
FIG. 10 is top view of a number wheel for combined corner and straight bets.
Figure 11:
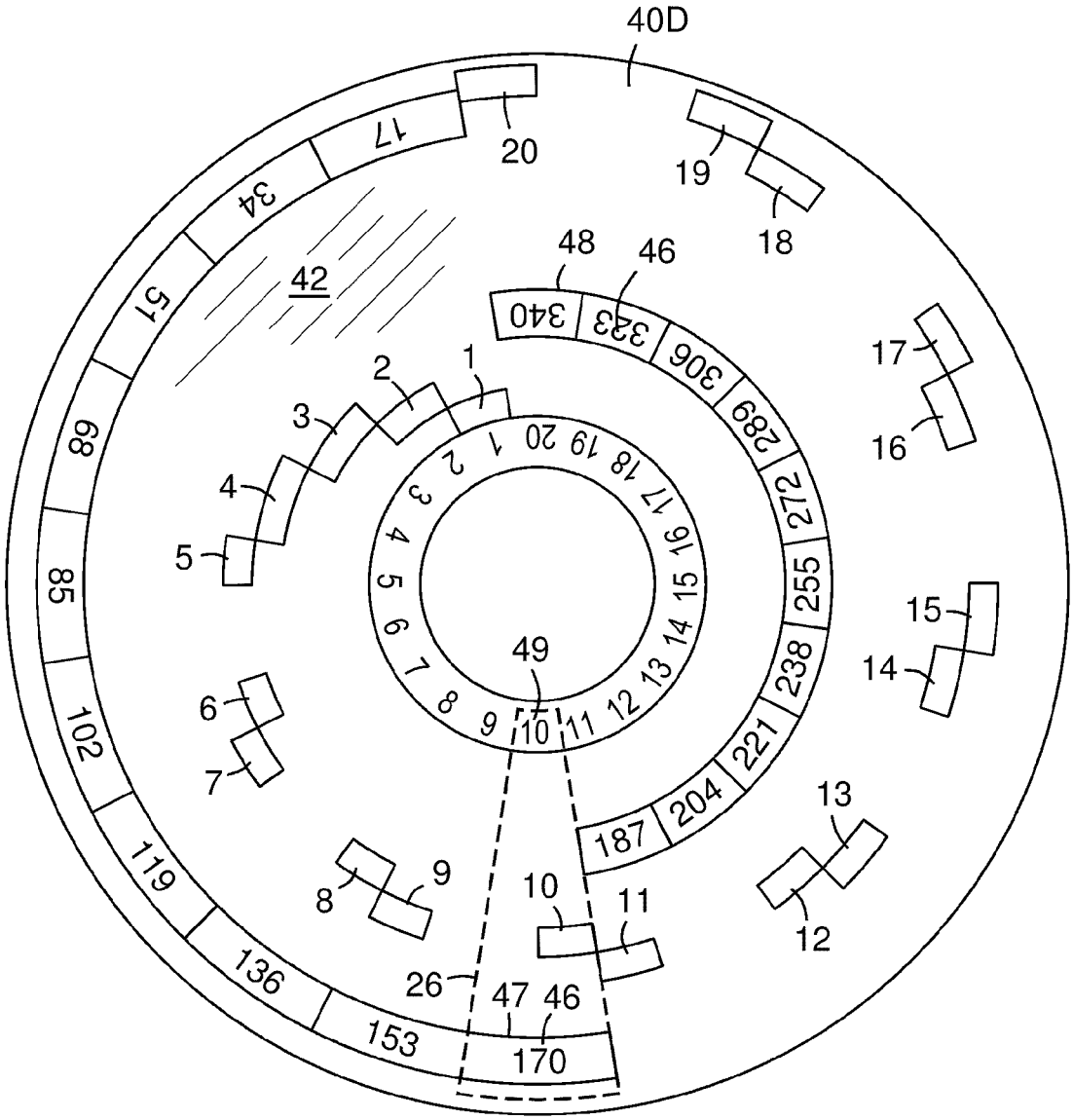
FIG. 11 is top view of a mask wheel for split bets.
Figure 12:
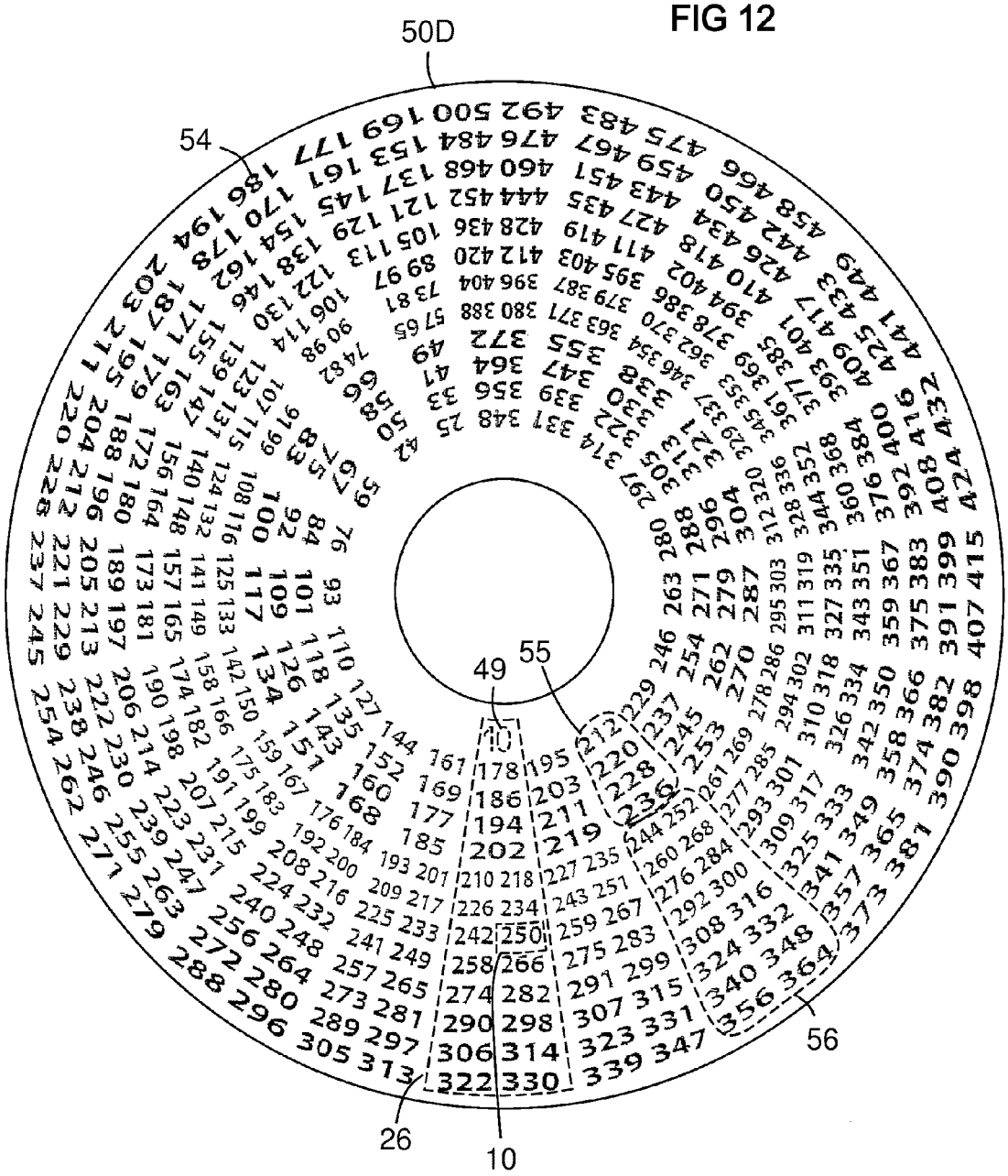
FIG. 12 is top view of a number wheel for combined split and corner bets.

FIG. 8 shows a roulette table 200 with a roulette wheel 202, a wagering layout 204, and with four attached calculators 100A, 100B, 100C, 100D for four different combinations of two bets. After winners are determined, the croupier operates an appropriate calculator for each combination of two bets supported by a calculator provided on the table. For single bets, the croupier may operate an appropriate calculator that computes multiple chips placed on the bet type via numeric labels 47. For combinations not supported by an available calculator, the croupier can compute two single bets if supported by an available calculator, and add them mentally.

FIGS. 9-12 show additional mask wheels 40C, 40D and number wheels 50C, 50D as indicated in the brief description of the drawings. Other mask and number wheels can be provided for other types of bets not specifically illustrated herein by using the concepts described herein in view of the examples shown. Any desired number of calculators may be attached to the table 200. They need not be horizontal. For example, they could be inclined toward the croupier.

The significant difference between the calculator 100A of FIG. 1 and the calculator 100B of FIG. 5 is that different numeric labels 47 are provided on the mask wheel, and different combined payout numbers are provided on the number wheel. Otherwise, the mechanisms are the same. Thus, different interchangeable number wheels and mask wheels can be provided in a set, so that a given gambling establishment can configure calculators as desired. Interchangeable identifying labeling 31, 33 should also be provided.

Herein "horizontal" and "vertical" may be used to describe relative positions and orientations of the calculator parts. These terms are not to be interpreted as absolute. For example, a calculator according to the invention may be turned on its side, attached to a wall, etc., and still meet a claim with such orientation terminology.

The second knob 33 may drive the number wheel by via gears 62, 64, 66 as shown herein. These gears are an example of an appropriate transmission, which may alternately be provided in the form of a chain and two sprockets, not shown.

A ring of numeric labels (not shown) may be attached around the second knob 32 under the cover plate 22, and appear through the window 27 in addition to the index numbers 68 to indicate payouts for multiples of chips placed on the single bet type controlled by the second knob. In this case, the window 27 may advantageously extend to the left of the second knob, so the payout numbers can be viewed horizontally and compactly through the window 27.

Although the present invention has been described herein with respect to preferred embodiments, it will be understood that the foregoing description is intended to be illustrative, not restrictive. Modifications of the present invention will occur to those skilled in the art. All such modifications that fall within the scope of the appended claims are intended to be within the scope and spirit of the present invention.

I claim:

1. A roulette payout calculator comprising:

a number wheel, a mask wheel, and a cover plate, forming an assembly wherein the mask wheel covers the number wheel, the cover plate covers the mask wheel, and the number wheel and mask wheel rotate relative to each other and relative to the cover plate about an axis;

multiple concentric circular arrays of combined payout numbers printed on the number wheel, each combined payout number indicating a total payout in chips for a combination of a first type of bet with a first number of chips N and a second type of bet with a second number of chips M;

multiple mask windows on the mask wheel, each mask window revealing one of the combined payout numbers on the number wheel, the combined payout number being revealed depending on a rotational position of the mask wheel relative to the number wheel;

a window on the cover plate that reveals a given mask window depending on a rotational position of the mask wheel relative to the cover plate;

first rotation means for manually rotating the mask wheel to a selectable rotational position representing N chips on the mask wheel; and second rotation means for manually rotating the number wheel to a selectable rotational position representing M chips on the number wheel;

wherein the cover plate window and one of the mask windows reveal a combined payout number on the number wheel indicating the total payout in chips for the combination of the first type of bet with N chips and the second type of bet with M chips.

2. The roulette payout calculator of claim 1, wherein the combined payout numbers on the number wheel are arranged in a circular array of radial wedges, each radial wedge comprising a subset of the combined payout numbers that indicate payouts for a range from 1 to a maximum number of chips placed on the first type of bet combined with a given number of chips placed on the second type of bet, wherein the selected rotational position of the number wheel representing M chips aligns a radial wedge for the number M under the cover plate window.

3. The roulette payout calculator of claim 2, wherein a radially inner portion of each radial wedge consists of a single radial column of the combined payout numbers, and a radially outer portion of each radial wedge comprises two radial columns of the combined payout numbers.

4. The roulette payout calculator of claim 3, wherein the assembly comprises a box, the cover plate comprises a cover on the box, the mask and number wheels are rotatably mounted on a first axle attached to the box, the first rotation means comprises a first knob centrally fixed to the mask wheel, the second rotation means comprises a second knob rotatably mounted on a second axle attached to the box, and the second knob drives the number wheel by a transmission.

5. The roulette payout calculator of claim 4, wherein the transmission comprises a first gear fixed coaxially to the number wheel, a second intermediate gear, and a third gear fixed coaxially to the second knob.

6. The roulette payout calculator of claim 4, wherein the multiple mask windows comprise:

a first subset of mask windows that extend to substantially a full width of the cover plate window, and are located on the mask wheel to reveal respective individual numbers in the single column of the combined payout numbers on the number wheels; and a second subset of mask windows that extend to approximately a half width of the cover plate window, and are so located on the mask wheel to reveal respective individual numbers in the double column of the combined payout numbers on the number wheel.

7. The roulette payout calculator of claim 1, further comprising a first ring of index numbers on the mask wheel in a range from 1 to a maximum number of chips for the first type of bet, which first ring of index numbers indicates the selected rotational position of the mask wheel.

8. The roulette payout calculator of claim 7, wherein only a single number of the first ring of index numbers is visible through a portion of the cover plate window at each selected rotational position of the mask wheel.

9. The roulette payout calculator of claim 8, wherein the numeric labels are arranged on the mask wheel in at least two arcs of the labels, each arc having a different radius arranged to avoid interfering with the mask windows.

10. The roulette payout calculator of claim 7, further comprising numeric labels on the mask wheel, each numeric label indicating a payout amount in chips for the first type of bet with a given number of chips at each selectable position of the mask wheel.

11. The roulette payout calculator of claim 1, wherein the number wheel is transparent or translucent, and the assembly further comprises a lamp below the number wheel and below the cover plate window, that backlights each combined payout number of the number plate that is visible through the cover plate window.

12. The roulette payout calculator of claim 1, further comprising a detent mechanism that engages the mask wheel and the number wheel and releasably stops each of them at the selected rotational positions thereof.

13. A roulette payout calculator comprising:

a first axle attached to a base, the first axle comprising an axis;

a number wheel mounted on the first axle;

a plurality of combined payout numbers printed on the number wheel, each combined payout number indicating a total payout for a combination of a first type of bet of a first amount and a second type of bet of a second amount;

a mask wheel rotatably mounted on the first axle covering the number wheel;

a cover plate connected to the base and covering the mask wheel;

a first manual input device attached to the mask wheel for manually turning the mask wheel about the axis to a first selectable position;

a second manual input device engaged with the number wheel for manually turning the number wheel to a second selectable position;

a cover window on the cover plate;

a plurality of mask windows on the mask wheel;

wherein for each of multiple selectable positions of the mask wheel and multiple selectable positions of the number wheel, one of the combined payout numbers of the number wheel is visible through both the cover window and a given one of the mask windows.

14. The roulette payout calculator of claim 13, further comprising a plurality of single payout numbers on the mask wheel;

wherein for each selectable position of the mask wheel, one of the single payout numbers is visible through the cover window, and indicates a payout for a single bet of the first type for a bet amount indicated by an index number in a ring of index numbers on the mask wheel.

15. A roulette table comprising a plurality of attached roulette payout calculators made according to claim 14, wherein each of the plurality of attached roulette payout calculators computes a different pair of bet types by using a differently numbered mask wheel and a differently numbered number wheel from others of the attached plurality of attached roulette payout calculators.

16. A set of roulette payout calculators made according to claim 14, comprising:

a plurality of interchangeable mask wheels, each interchangeable mask wheel configured for a different type of bet than other mask wheels in the set; and a plurality interchangeable number wheels, each number wheel configured for a different type of bet than other number wheels in the set.

17. A roulette payout calculator, comprising:

a base;

a first vertical axle attached to the base;

a mask wheel rotatably mounted on the first vertical axle;

a plurality of windows on the mask wheel;

a plurality of single payout numbers on the mask wheel;

a ring of first index numbers on the mask wheel;

a cover plate attached to the base and disposed above the mask wheel;

a window on the cover plate;

a first manual input device connected to the mask wheel that rotates the mask wheel to a first rotatable position indicated by a selected one of the first index numbers;

a number wheel rotatably mounted on the first vertical axle below the mask wheel;

a second manual input device that engages the number wheel, wherein the second manual input device comprises a ring of second index numbers, and rotates the number wheel to a second rotatable position indicated by a selected one of the second index numbers; and the number wheel comprising a surface with a plurality of combined payout numbers, each combined payout number indicating a combined payout for a first type of bet of a first amount plus a second type of bet of a second amount;

wherein, when the first index number indicates the first bet amount and the second index number indicates the second bet amount, the combined payout number is visible through both the mask wheel window and the cover plate window, and one of the single payout numbers is also visible through the cover plate window indicating a payout for the first type of bet of the first amount.

* * * * *